US007213797B2

(12) United States Patent
Gaskins

(10) Patent No.: US 7,213,797 B2
(45) Date of Patent: May 8, 2007

(54) DECK BOARD STRAIGHTENER

(76) Inventor: Garland Jerome Gaskins, 8160 Frytown Rd., Warrenton, VA (US) 20187

( * ) Notice: Subject to any disclaimer, the term of this patent is extended or adjusted under 35 U.S.C. 154(b) by 0 days.

(21) Appl. No.: 11/437,178

(22) Filed: May 19, 2006

(65) Prior Publication Data

US 2006/0261319 A1 Nov. 23, 2006

Related U.S. Application Data

(60) Provisional application No. 60/683,285, filed on May 20, 2005.

(51) Int. Cl.
*B66F 3/00* (2006.01)
*B25B 1/00* (2006.01)

(52) U.S. Cl. ..... 254/15; 269/6; 269/95; 254/11

(58) Field of Classification Search ..... 269/6, 269/3, 71, 95
See application file for complete search history.

(56) References Cited

U.S. PATENT DOCUMENTS

| | | | | |
|---|---|---|---|---|
| 3,499,206 | A * | 3/1970 | Quernheim | 29/239 |
| 6,722,643 | B1 * | 4/2004 | Kurtz | 269/249 |
| 7,013,770 | B2 * | 3/2006 | Williams | 81/484 |
| 2002/0125624 | A1 * | 9/2002 | Wang | 269/6 |
| 2006/0261319 | A1 * | 11/2006 | Gaskins | 254/15 |

* cited by examiner

*Primary Examiner*—Lee D. Wilson
(74) *Attorney, Agent, or Firm*—White-Welker & Welker, LLC

(57) ABSTRACT

A deck board straightener is taught which is comprised of a main rod part connected to a handle at one end and a flat steel plate at the opposing end. The flat plate is comprised of two shoulders that consist of the bent edges of the flat plate but could also be shoulder elements separately attached to the flat plate. The shoulders can spaced at a fixed distance apart or be made adjustable to allow for use on a varying material thickness. A securing screw can be placed through one shoulder to provide additional material securing means. A pressure jaw is attached to the flat steel plate and a quick-grip mini bar clamp in a manner that also allows for rotating movement. When in use, the pressure jaw secures material such as a deck board against the flat plate and shoulders.

4 Claims, 6 Drawing Sheets

DECK BOARD STRAIGHTENER

CROSS REFERENCE TO RELATED APPLICATIONS

This application claims priority from U.S. Provisional Patent Application 60/683,285, entitled "Deck Board Straightener", filed on May 20, 2005.

This application is an improvement of U.S. Design Pat. D485,477, entitled "Deck Board Straightener", issued to Garland Jerome Gaskins on Jan. 20, 2004.

TECHNICAL FIELD OF THE INVENTION

The present invention relates generally to the field of tools useful for floor installation or repair. More specifically the present invention relates to a floor tool designed to aid in the repair and installation of wooden flooring by forcing abutting edges of individual pieces of flooring into proper position until they can be fastened into place.

BACKGROUND OF THE INVENTION

Traditionally the installation and repair of wooden flooring has required two carpenters. To assure a tight fit between the individual pieces of flooring the first carpenter forces the flooring being installed or repaired into proper position, while the second carpenter securely fastens the flooring being held to the sub floor. To insure that the floor is held tightly together it has generally been the situation that nails are driven into the flooring in an abutment arrangement with the piece of flooring previously put in place. In this manner the floor is constructed, one piece at a time, gradually being laid from the base of a starting wall towards the base of an ending wall where the last piece is placed.

In another common installation and repair of flooring, one carpenter works alone to replace and secure the flooring. One carpenter, working alone, faces even more difficulty in placing the floor and must commonly use a nail or wedge to maintain the flooring in its desired location while nailing it into place. This situation also requires the carpenter to continually stand and kneel, kneeling to place the board, standing to obtain leverage to place the board in its location, and kneeling again to hammer the board into place.

It is therefore an object of the invention to enable a single carpenter to stand and pry boards into place with little to no effort with a hands free holding device.

It is another object of the invention to develop a tool that eliminates the need for a carpenter to remain on their knees for prolonged periods of time prying boards together. This present invention enables a carpenter to remain standing during the installation of flooring boards eliminating the painful knee and back problems associated with the trade.

SUMMARY OF THE INVENTION

In accordance with the present invention a deck board straightener is provided which eliminates the extra man power necessary to install flooring when only one carpenter is available to do the work.

The main objected of the present invention is to enable one carpenter to stand and pry new or warped boards into place with little to no effort. A preferred embodiment of the present invention is described herein and shown in the Figures.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

Figure 1:
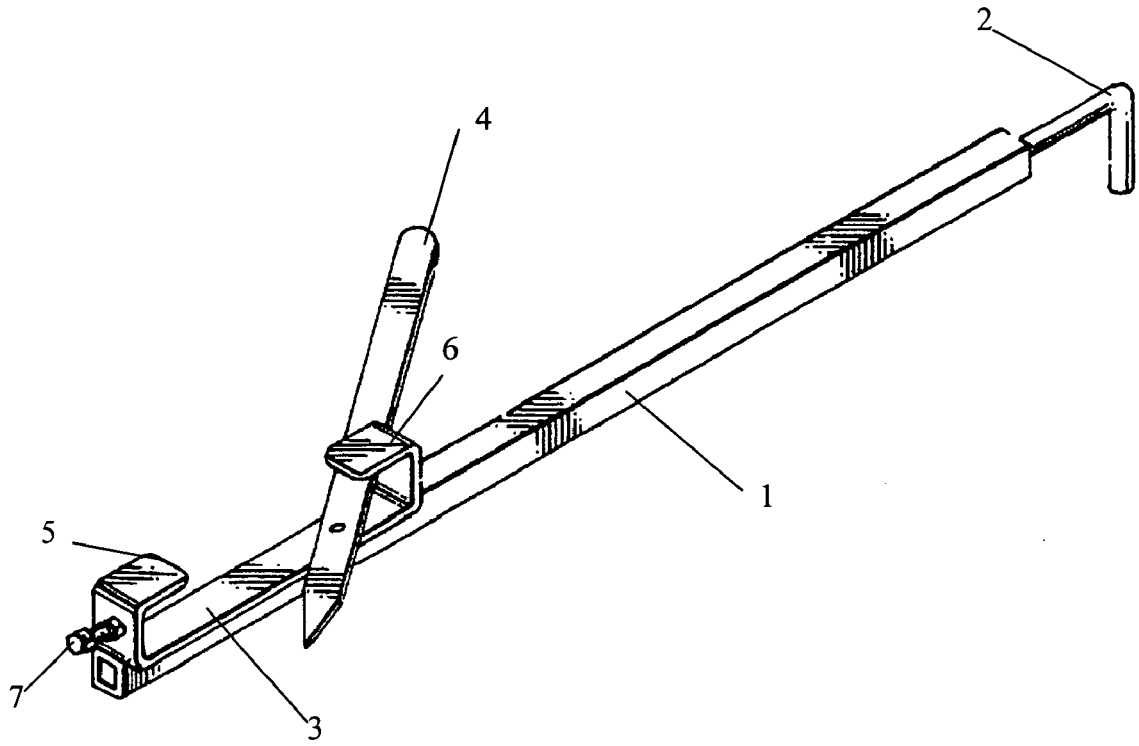
Fig. 1 Prior Art
FIG. 1 is a top, right front perspective view of a known deck board straightener.

Referring to the figures, it is possible to see the various major elements constituting the device of the present invention. Now referring to FIG. 1, the major components of a deck board straightener known in the prior art are illustrated. The original Gaskins deck board straightener was comprised of a first rod part 1, a second rod part 2 used as a handle, a welded or otherwise fixed flat plate 3, and a pressure arm 4. The flat plate 3 was attached to the first rod part 1, and also comprised of two shoulders 5 and 6. These shoulders 5 and 6 consist of the bent edges of the flat plate 3 but could also be shoulder elements separately attached to the flat plate 3. The shoulders 5 and 6 can spaced at a fixed distance apart or be made adjustable to allow for use on a varying material thickness. Additionally, a securing screw 7 can be placed through one shoulder to provide additional material securing means.

The pressure arm 4 was attached to the flat plate 3 in such a manner to allow rotating motion. When material, such as a deck board is placed in the device, the shoulders Sand 6 in combination with the pressure arm 4 secure the material and allow a user to apply pressure to the material in an effort to move or bend the material into a desired location.

Figure 2:
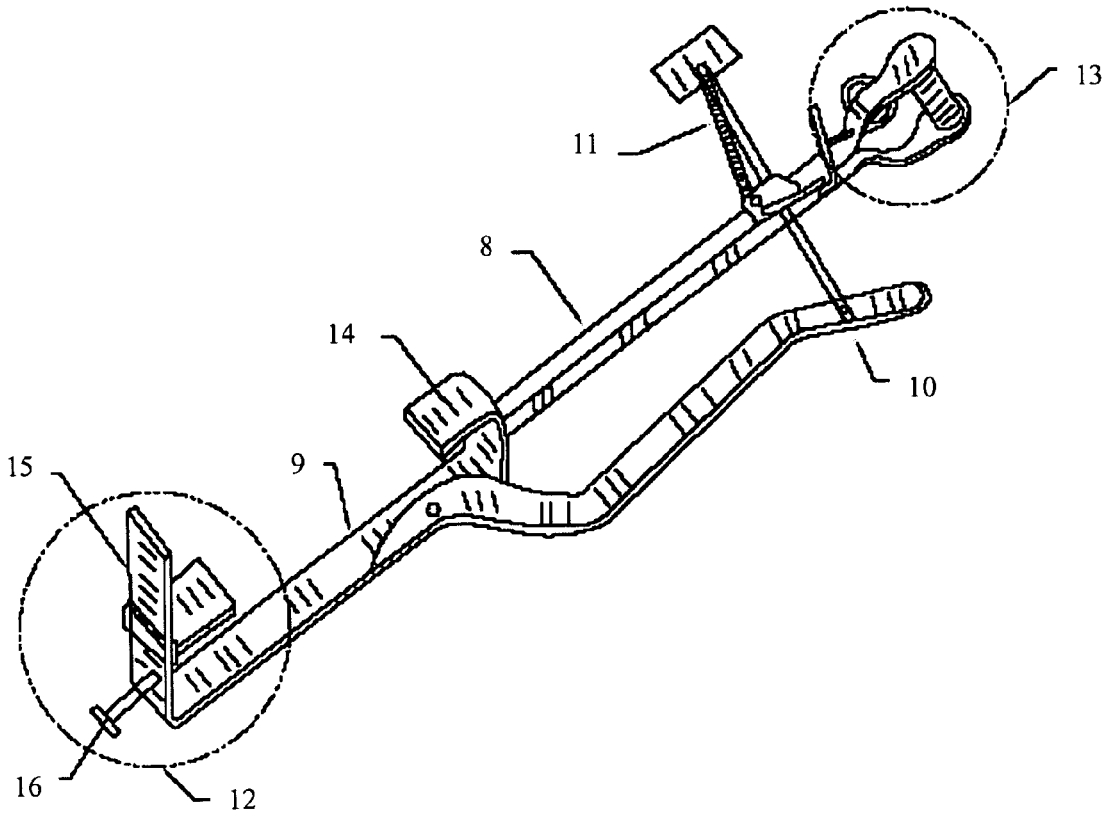
FIG. 2 is a perspective view of the deck board straightener of the present invention.

Now referring to FIG. 2 a perspective view of the deck board straightener of the present invention is illustrated. A main rod part 8 made of steel tubing connect to a handle 13 at one end and a flat steel plate 9 at the opposing end. The flat steel plate 9 is comprised of two shoulders 14 and 15. These shoulders 14 and 15 consist of the bent edges of the flat plate 3 but could also be shoulder elements separately attached to the flat plate 3. The shoulders 5 and 6 can spaced at a fixed distance apart or be made adjustable to allow for use on a varying material thickness. Additionally, a securing screw 16 can be placed through one shoulder to provide additional material securing means.

A pressure jaw 10 is attached, at one end, to the flat steel plate 9 in a manner that also allows for rotating movement. The opposing end of the pressure jaw 10 is attached to a quick-grip mini bar clamp 17. When in use, the pressure jaw 10 secures material such as a deck board against the flat steel plate 9 and shoulders 14 and 15.

Figure 3:
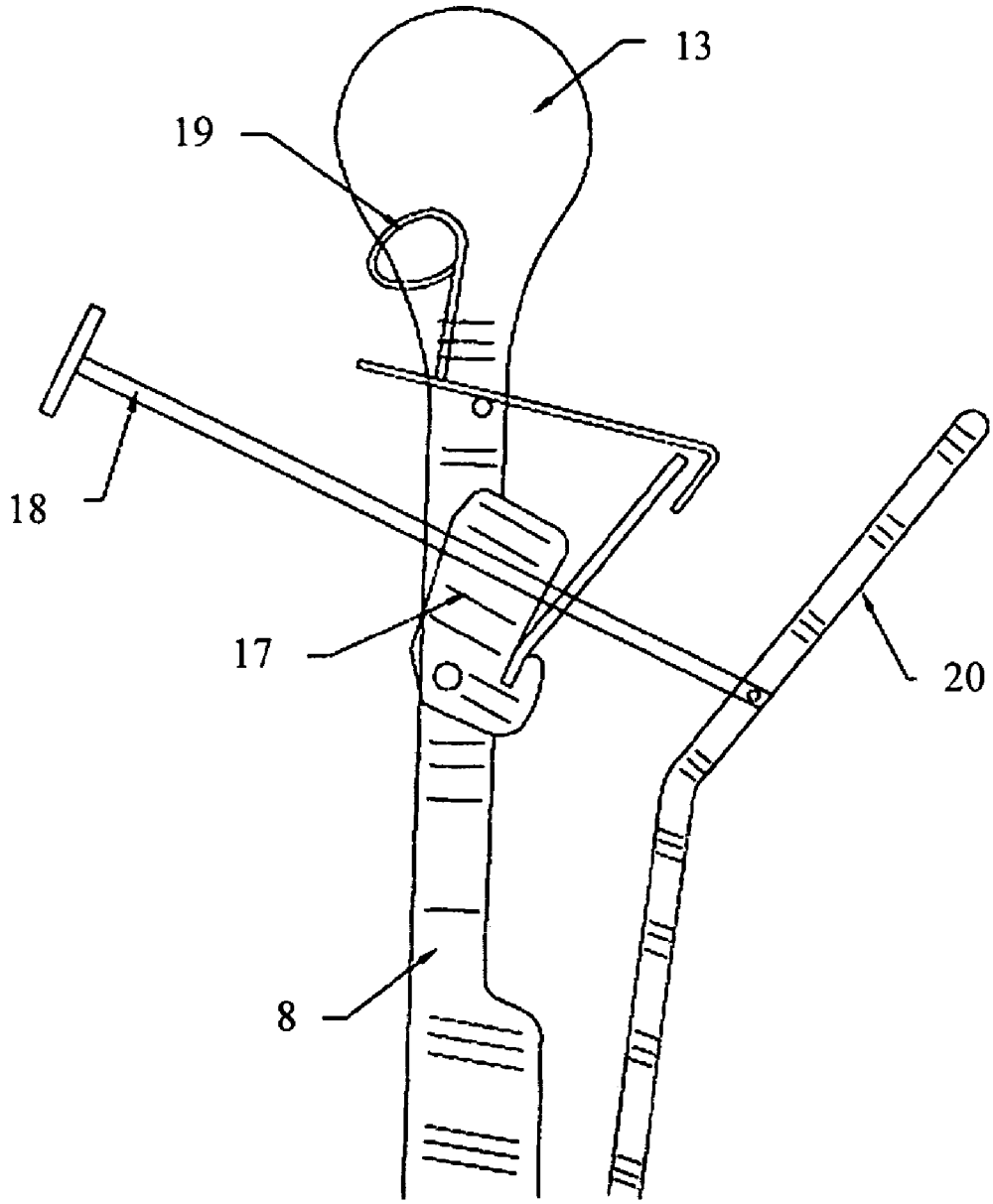
FIG. 3 is a perspective view of the quick grip mini bar clamp section of the present invention.

Now referring to FIG. 3 a perspective view of the quick grip mini bar clamp 17 section of the present invention is illustrated. The quick grip mini bar clamp 17 is affixed to the flat plate 3 near the handle 13. The quick grip mini bar clamp 17 is comprised of a sliding bar 18 that is connected to the pressure jaw 10 and a quick release trigger 19. In a preferred embodiment, a user would place material in the flat steel plate 9 and pull the upper portion 20 of the pressure jaw 10 to secure the material in place. Then, after positioning the material in place, the user pulls the quick release trigger 19 that allows the sliding bar 18 to move and release the pressure jaw 10 from the material.

Figure 4:
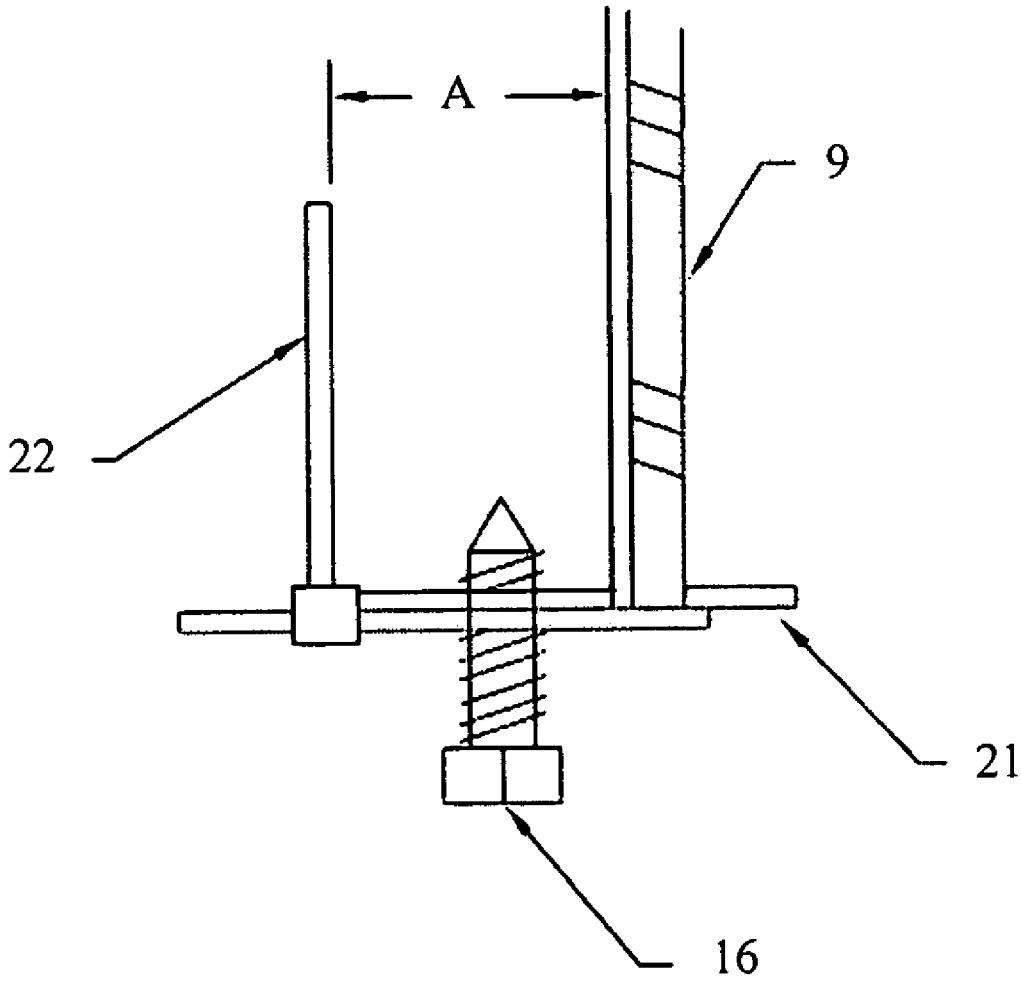
FIG. 4 is a perspective of the securing screw of the present invention.

FIG. 4 illustrates one possible configuration of the securing screw 16 and one shoulder 15 of the flat steel plate 9. In a preferred embodiment, the lower shoulder 15 is a second flat steel plate 21 that is perpendicular to the flat steel plate 9. Attached to the second flat steel plate 21 is a third flat steel plate 22, which is parallel to the flat steel plate 9 and may slide along the second steel plate 21. The adjustability of the third steel plate 22 to move allows a user to easily adjust the A dimension of the present invention for varying work material thickness, allowing the device to be used for a variety of materials. More specifically, in a preferred embodiment, the third steel plate 22, may be place in either of two positions, one with an A dimension equal to the thickness of one floor joist or a second A dimension equal to the thickness of a double floor joist.

Figure 5:
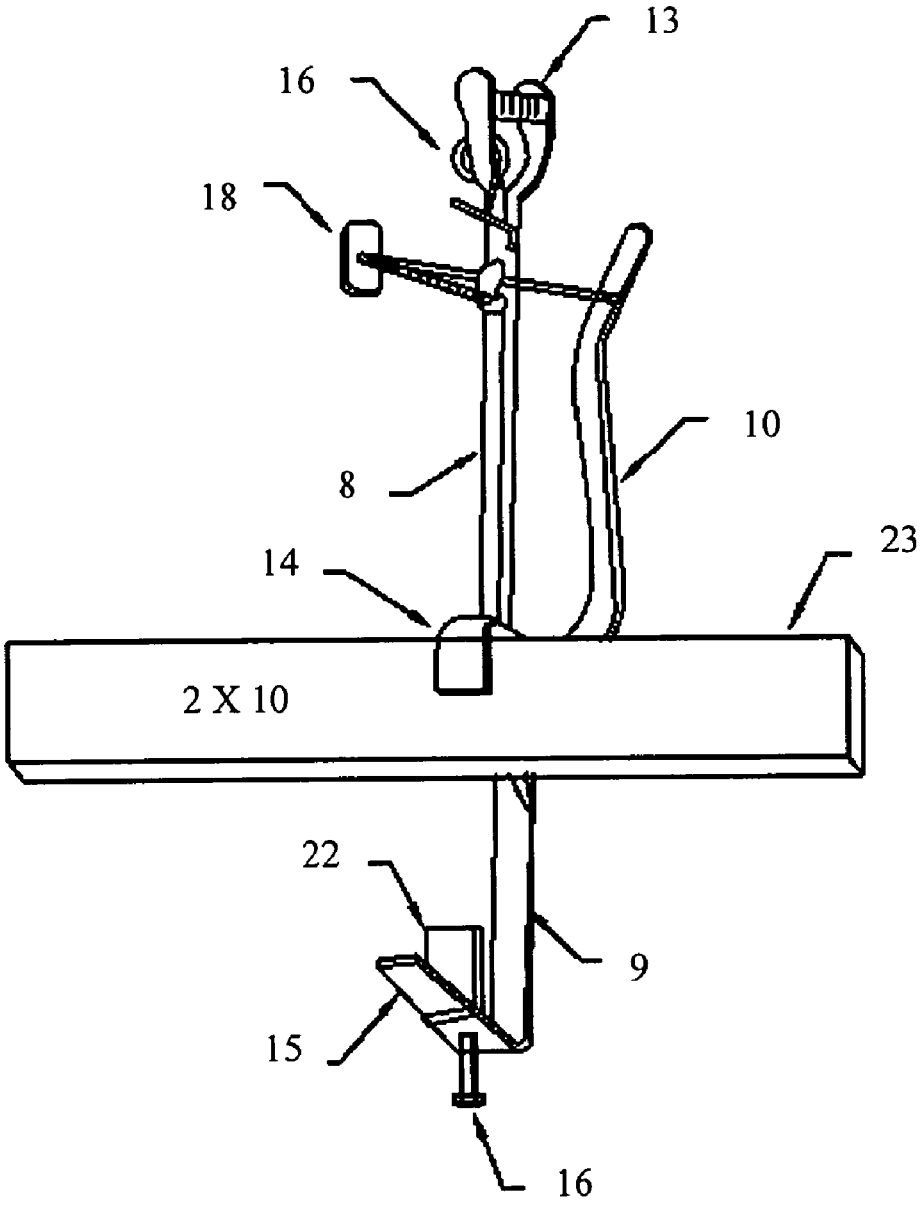
FIG. 5 is a perspective view of the present invention resting on a 2×10, for short-term storage when not in use.
Figure 6:
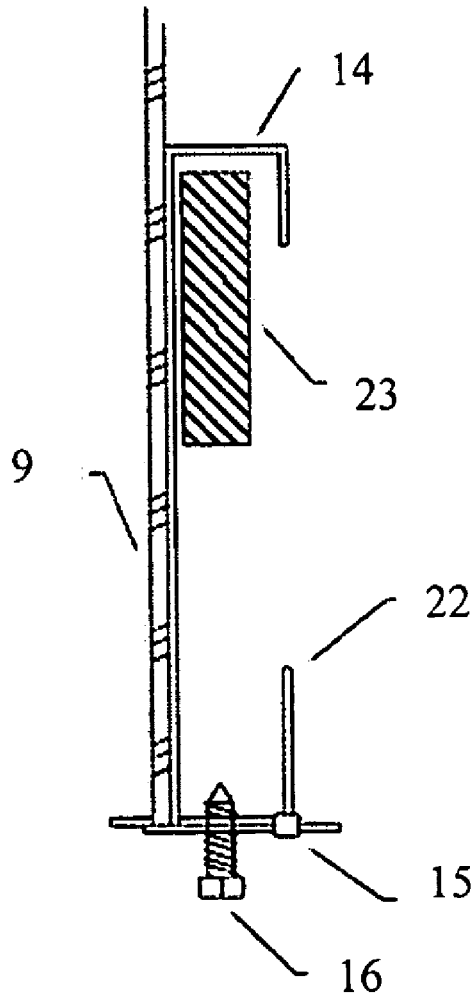
FIG. 6 is a second perspective view of the present invention resting on a 2×10, for short-term storage when not in use.

FIGS. 5 and 6 are perspective views of the present invention resting on a 2×10 deck board 23, for short-term storage when not in use. In a preferred embodiment, the upper shoulder 14 creates a hanger with the flat steel bar 9 that allows a user to hang the device of the present invention on a floor or deck frame rather than lying the device on the ground and continually having to bend over to sit down and pick up the device before and after use.

To use the deck board straightener of the present invention, one first pulls up on the deck board straightener to drive the securing screw 16 into the floor joist, then pulls back on the handle 13 until the deck board is in the desired location. Once the deck board is in the desire location, the pressure jaw is pulled into position by the user, securing the deck board. Next, the user would secure the deck board to the floor joist by nailing or screwing the deck board into place. Once completed, the user would simple pull the release trigger 16 and the pressure jaw 10 would be released. Additionally the user can use the upper shoulder 14 to rest the deck board straightener of the present invention on an exposed floor joist while retrieving another deck board or while the device is not in use.

It is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The invention claimed is:

1. A deck board straightening device comprising:

a main rod part consisting of a steel tube connected to a handle at one end and a flat steel plate at the opposing end;

the flat steel plate is further comprised of two shoulders;

said shoulders consist of the bent edges of the flat steel plate said shoulders can spaced at a fixed distance apart;

a pressure jaw is attached, at one end, to the flat steel plate in a manner that also allows for rotating movement;

the opposing end of the pressure jaw is attached to a quick-grip mini bar clamp: and a securing screw placed through one shoulder to provide additional material securing means.

2. A deck board straightening device comprising:

a main rod part consisting of a steel tube connected to a handle at one end and a flat steel plate at the opposing end;

the flat steel plate is further comprised of two shoulders;

said shoulders consist of the bent edges of the flat steel plate said shoulders can spaced at a fixed distance apart;

a pressure jaw is attached, at one end, to the flat steel plate in a manner that also allows for rotating movement;

the opposing end of the pressure jaw is attached to a Quick-grip mini bar clamp; and wherein the quick grip mini bar clamp is comprised of a sliding bar that is connected to the pressure jaw and a quick release trigger.

3. A deck board straightening device comprising:

a main rod part consisting of a steel tube connected to a handle at one end and a flat steel plate at the opposing end;

the flat steel plate is further comprised of two shoulders;

said shoulders consist of the bent edges of the flat steel plate said shoulders can spaced at a fixed distance apart;

a pressure jaw is attached, at one end, to the flat steel plate in a manner that also allows for rotating movement;

the opposing end of the pressure jaw is attached to a quick-grip mini bar clamp;

a lower shoulder which is a second flat steel plate that is perpendicular to the flat steel plate;

attached to the second flat steel plate is a third flat steel plate, which is parallel to the flat steel plate and may slide along the second steel plate; and the adjustability of the third steel plate to move provides means for adjusting the A dimension for varying work material thickness.

4. The deck board straightening device of claim 3 wherein the third steel plate, is placed in either of two positions, one with an A dimension equal to the thickness of one floor joist or a second A dimension equal to the thickness of a double floor joist.

* * * * *